US007240447B2

(12) United States Patent
Humphrey

(10) Patent No.: US 7,240,447 B2
(45) Date of Patent: Jul. 10, 2007

(54) MIX AND MATCH FRAMING SYSTEM

(76) Inventor: Neall Humphrey, 18124 Wedge Pkwy. #407, Reno, NV (US) 89511

( * ) Notice: Subject to any disclaimer, the term of this patent is extended or adjusted under 35 U.S.C. 154(b) by 381 days.

(21) Appl. No.: 10/864,608

(22) Filed: Jun. 8, 2004

(65) Prior Publication Data

US 2005/0268510 A1 Dec. 8, 2005

(51) Int. Cl.
*A47G 1/08* (2006.01)

(52) U.S. Cl. ..... 40/740; 40/777

(58) Field of Classification Search ..... 40/768, 40/770, 777, 740, 753, 724, 791, 794, 796; 24/457, 531, 532; 248/74.5, 316.5; 292/288, 292/300, DIG. 11

See application file for complete search history.

(56) References Cited

U.S. PATENT DOCUMENTS 132,314 A * 10/1872 Moulton ..... 40/732
4,991,801 A * 2/1991 Trumbull ..... 248/74.2
6,035,571 A * 3/2000 Hsu ..... 40/757
D491,442 S * 6/2004 Cordero et al. ..... D8/354
7,055,786 B2 * 6/2006 Garassino et al. ..... 248/220.22
2001/0045043 A1 * 11/2001 Lebrun ..... 40/800
2005/0028418 A1 * 2/2005 Pargman ..... 40/717

* cited by examiner

*Primary Examiner*—Joanne Silbermann
(74) *Attorney, Agent, or Firm*—Greenberg Traurig, LLP

(57) ABSTRACT

A mix and match framing system comprising a frame adapted to receive artwork, such as a mirror, painting, print or the like therein. The frame includes a ledge or ridge against which the artwork abuts and swivelled closure members at spaced locations on the back of the frame for securing the artwork in place. The system also includes spacing elements that may be used to compensate for differences in thickness of the artwork.

6 Claims, 8 Drawing Sheets

MIX AND MATCH FRAMING SYSTEM

BACKGROUND OF THE INVENTION

1. Field of the Invention

The invention relates to framing systems; and, more particularly, to framing systems adapted to accommodate differing types of artwork.

2. Related Art

Frames for framing artwork are well known. Generally, if one wanted to frame a particular work of art, one had to select a particular frame that might not be suitable for another type of artwork. There is a need for a framing system that includes closure members for holding the artwork in position within the frame, spacer means for compensating for the difference in thicknesses of particular types of artwork and closure members fixed to the frame for securing the artwork within the frame.

SUMMARY OF THE INVENTION

It is an object of this invention to provide a mix and match framing system for accommodating differing types and thicknesses of artwork.

DESCRIPTION OF THE PREFERRED EMBODIMENTS

Figure 1:
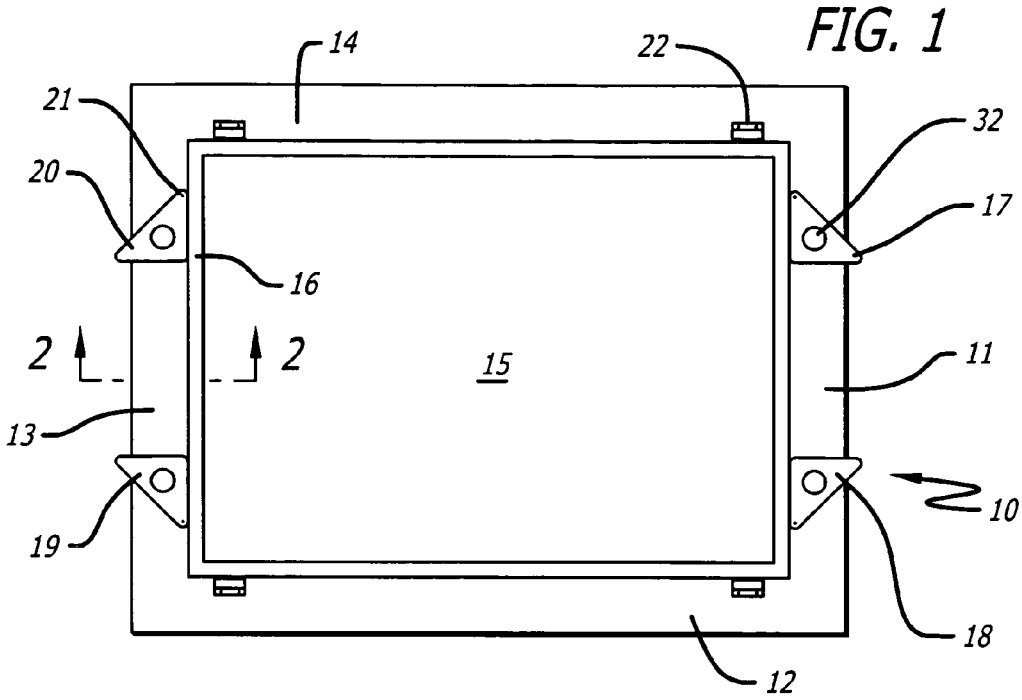
FIG. 1 is a rear plan view of the framing system of the invention, the spacers being omitted for convenience of illustration.
Figure 2:
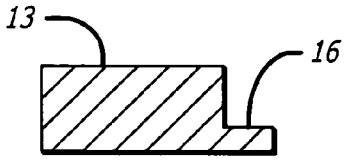
FIG. 2 is a view taken along 2-2 of FIG. 1.

A mix and match framing system (FIG. 1) is disclosed comprising a generally rectangular frame 10 having interconnected sides 11 to 14 framing a central opening 15 with an inner peripheral ridge or flange 16 extending about the periphery of opening 15 of a thickness less than the thickness of sides 11 to 14, as seen in FIG. 2, thus providing a shelf or support for a painting, mirror, artwork, etc. of like configuration to flange 16, as will be discussed.

Figure 4:
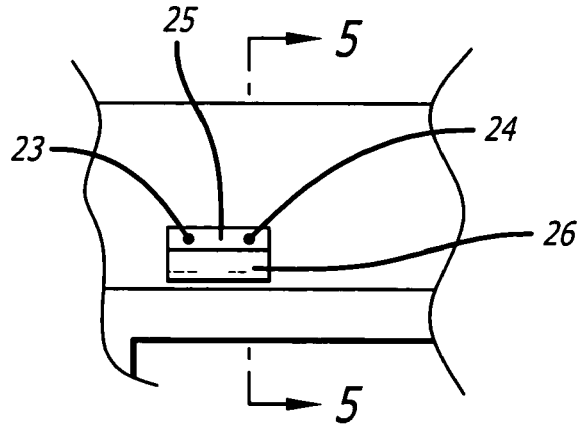
FIG. 4 is a plan view of a portion of the frame of FIG. 1 illustrating one of the retaining clip portion of one of the closure members.
Figure 5:
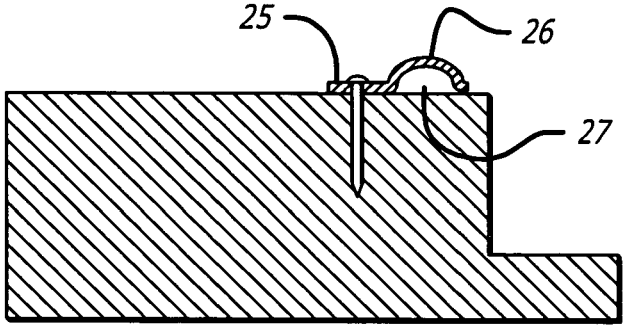
FIG. 5 is a view taken along lines 4-4 of FIG. 4.

Frame 10 includes a plurality, such as four, of closure members 17 to 20, in the preferred form of generally triangularly shaped swiveled members each having one end riveted or otherwise secured to frame 10, as by swivel rivet 21, a clip 22 is associated with each member 17 to 20 (see particularly FIGS. 4 and 5) fixed to frame 10 by rivets 23, 24 (FIG. 4) through flat portion 25 which includes an integral cylindered restraint sleeve 26 split along one side at split 27 (see FIG. 5).

Figure 3:
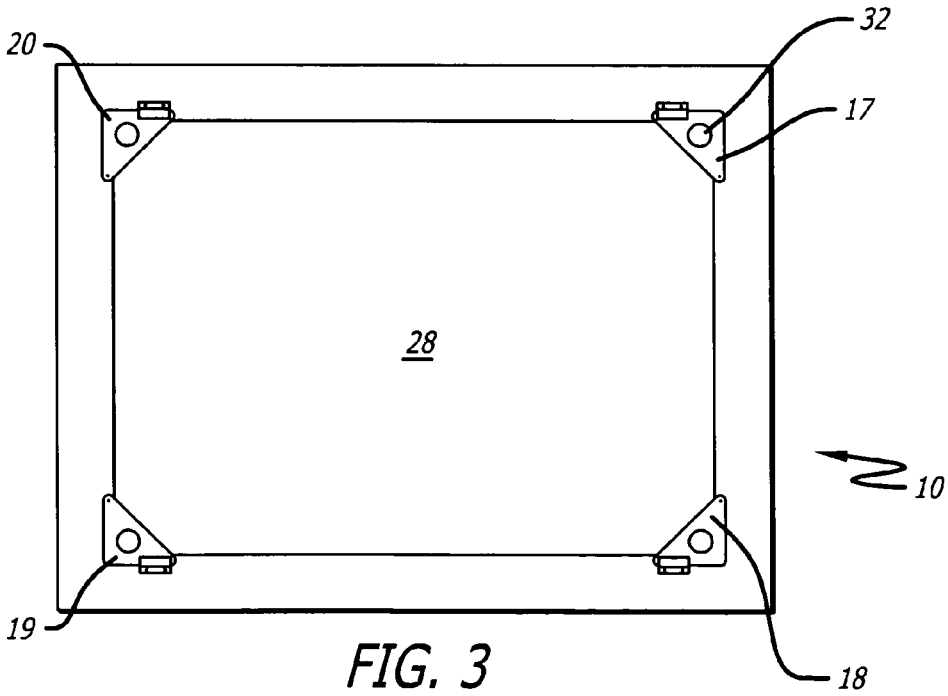
FIG. 3 is a view similar to FIG. 1 with a backing in position retained to the frame by closure members.

Thus, as seen in FIG. 3, a framed mirror assembly is shown having a fiberboard backing 28 mounted in opening 15 in frame 10. Each member 17 to 20 in FIG. 3 has been swiveled to a position overlying backing 28 to hold it in position within frame 10. In this position, each member 17 to 20 has been snap fit into their respective sleeves 26 through the split 27 therein and thus firmly retained in position.

Figure 6:
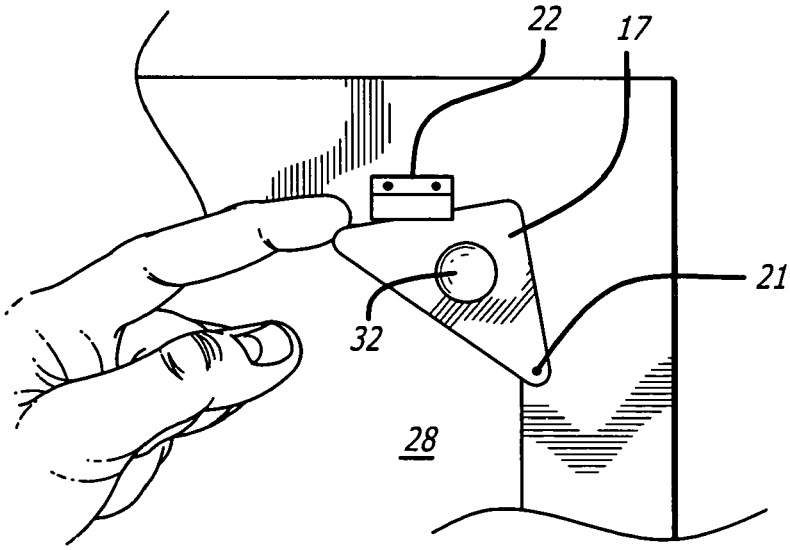
FIG. 6 is a view of a corner of the frame of FIG. 1 showing operation of one of the closure members.
Figure 7:
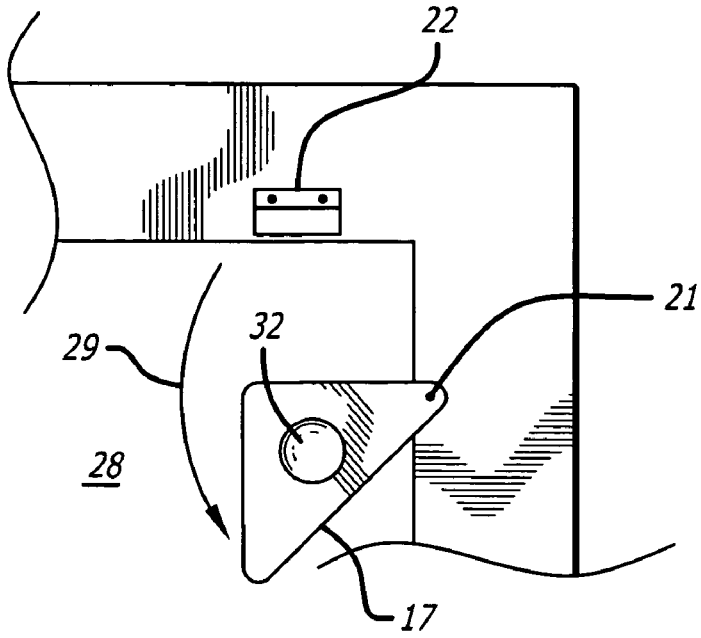
FIG. 7 is a view similar to FIG. 6 further illustrating operation of one of the closure members.
Figure 8:
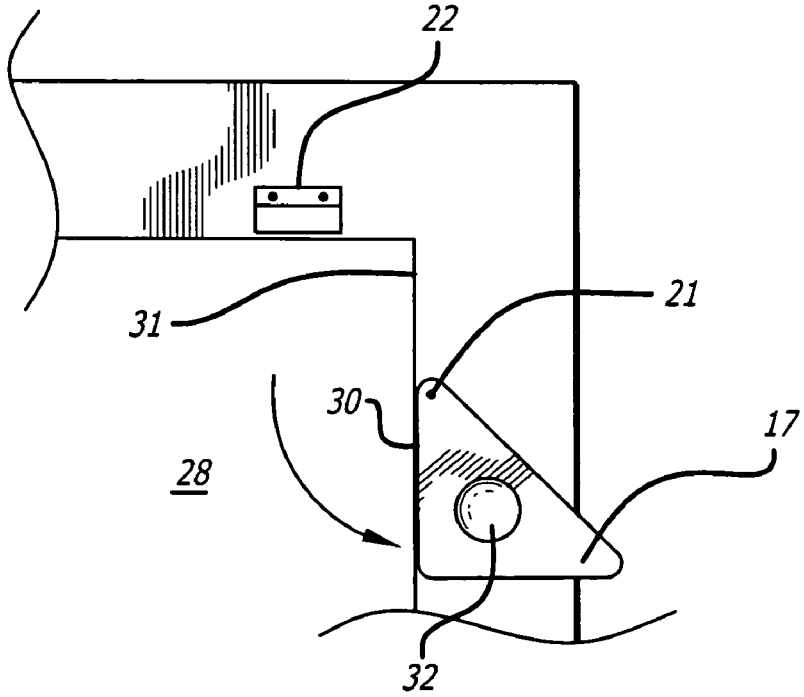
FIG. 8 shows a subsequent position of the closure member of FIGS. 6 and 7.

As seen in FIG. 6, the member 17 is pivoted about rivet 21 and removed from engagement with clip 22, then moved in the direction of arrow 29 (FIG. 7) to the position shown in FIG. 8 wherein edge 30 is flush with the edge 31 of backing 28. Also as seen in FIGS. 1, 3 and 6 to 8, each member 17 to 20 has an inwardly extending concave depression 32 formed therein which abuts against the backing 28 when in the FIGS. 3, 6 and 7 position to bear against backing 28 and hold it firmly in position.

Each member 17 to 20 is thus swiveled out of its respective clip 22 in like manner allowing removal of backing 28 from the frame 10.

Figure 9:
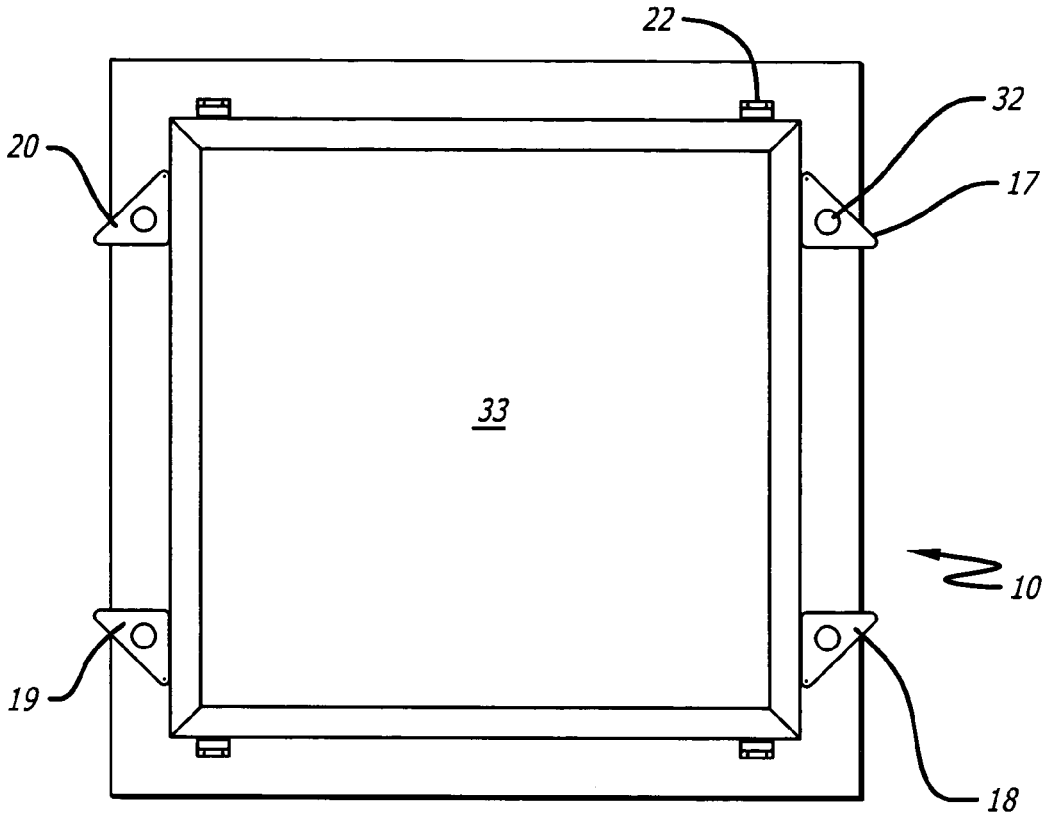
FIG. 9 illustrates the placement of a framed mirror into the frame of FIG. 1.

Any artwork or other mounted material, such as the framed mirror 33 shown in FIG. 9, can now be removed from frame 10 resulting in the open framework shown in FIG. 1.

The assembly may be reversed starting with the open framework shown in FIG. 1, with members 17 to 20 in the FIG. 8 position, with a painting, mirror, art canvas, etc., placed within opening 15 on ledge 16. Backing 28, which is optional, may now be placed over the artwork and each member 17 to 20 is swiveled from the position shown in FIG. 8 to the locking engagement into its respective clip 22 as shown in FIG. 3.

It can be seen that there is disclosed a system for quickly and easily framing any suitable artwork, such as a mirror, an oil painting, art canvas, photograph, etc., by choosing a frame, such as frame 10, with members 17 to 20 and clips 22 mounted thereon, an optional backing, such as backing 28, which may come with the frame 10, and spacers to compensate for the differences in thickness of the various types of artwork.

Figure 10:
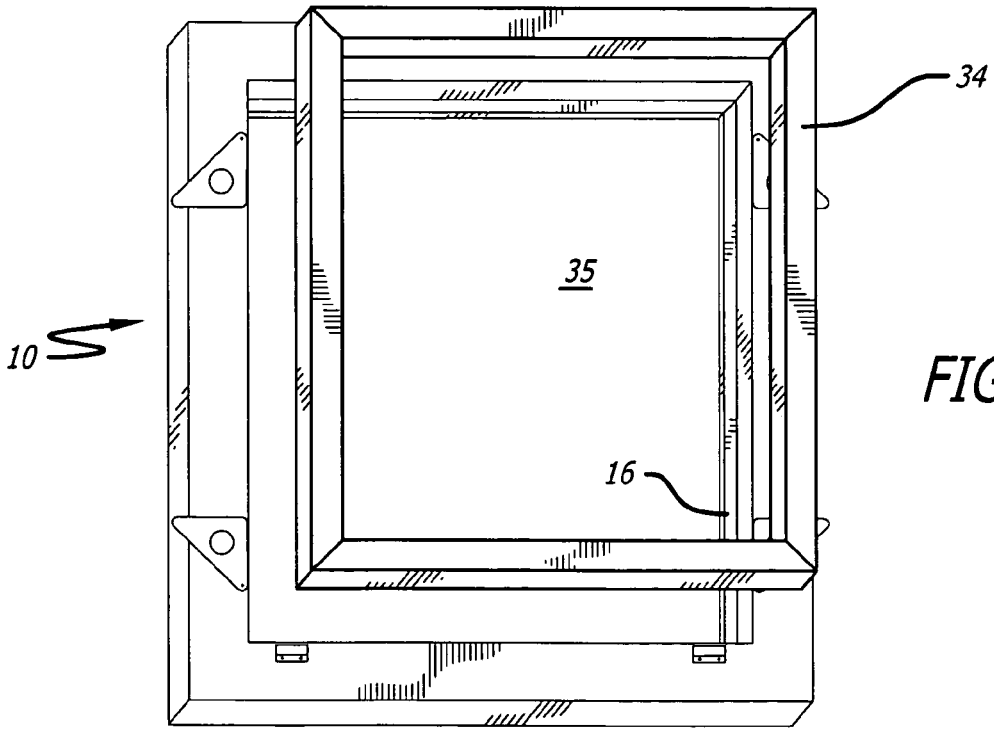
FIGS. 10 through 15 are exploded view illustrating various types of spacers that may be used in the system of FIG. 1.

For example, a plurality of differing types of spacers that may be used with frame 10 (members 17 to 20 and clips 22 omitted for convenience of illustration) as shown in FIGS. 10 to 15. A frame spacer 34 is shown in FIG. 10 adapted to abut against ledge 16 (FIG. 2). This spacer 34 (FIG. 10) has an inner open rectangular framework 35 so that it can frame a painting or the like mounted thereagainst.

Figure 12:
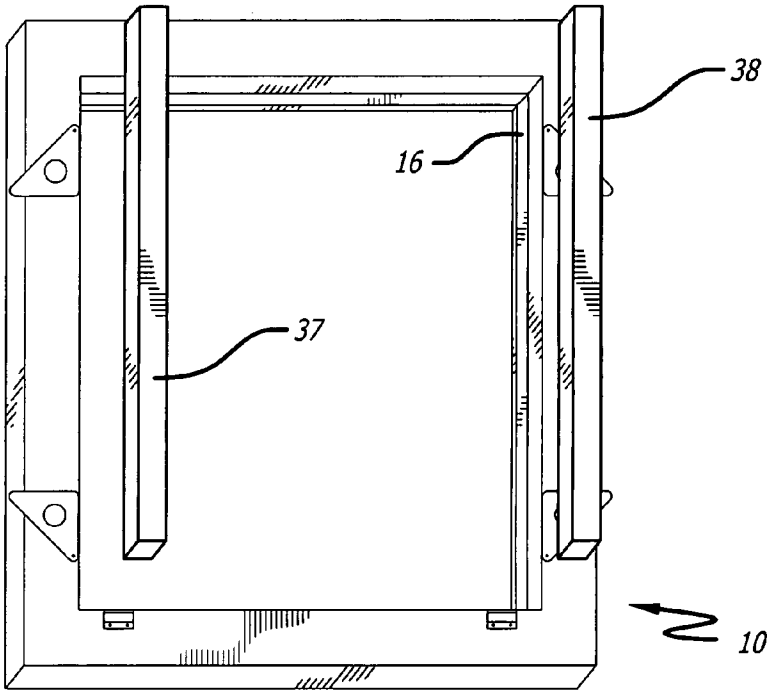
Figure 11:
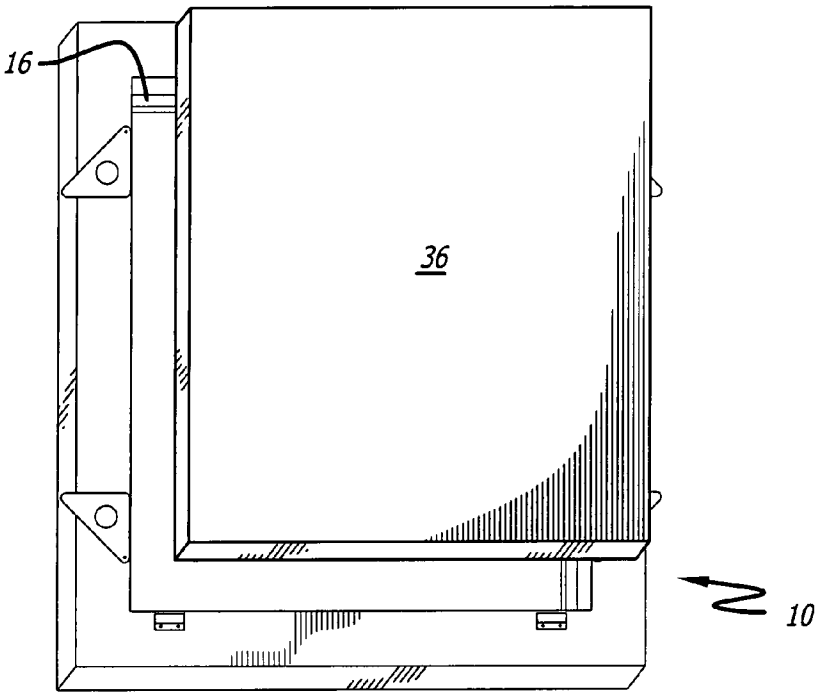
Figure 15:
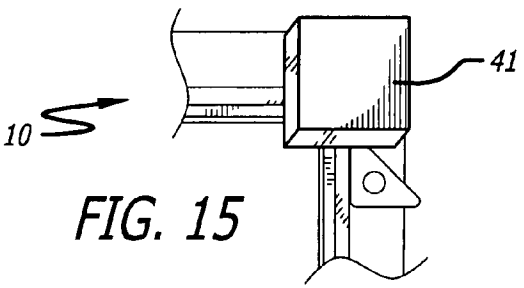
Figure 14:
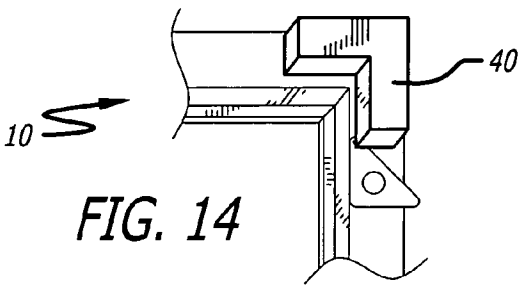
Figure 13:
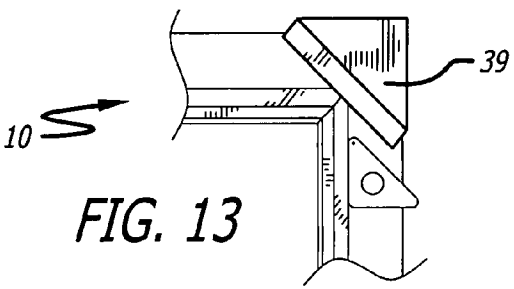

A flat panel 36 is shown in FIG. 11 adapted to be mounted against ledge 16. A plurality of elongated strips, such as strips 37, 38, are shown in FIG. 12 adapted to be mounted against ledge 16. As seen in FIGS. 13 to 15, corner members 39 to 41, of varying configurations, may be mounted in each corner of frame 10.

Figure 17:
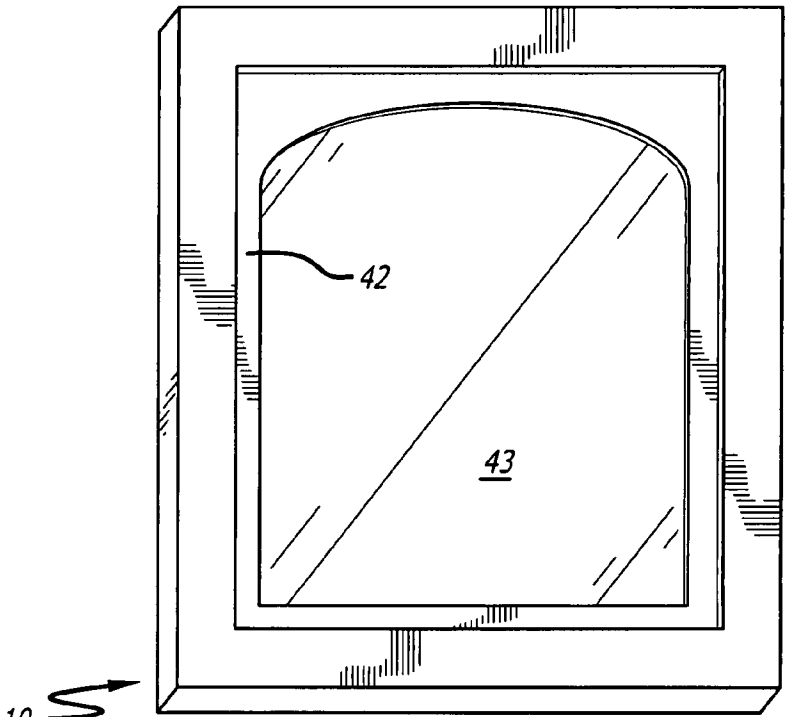
FIG. 17 is a plan view of the mat and mirror of FIG. 16 mounted in the frame of FIG. 1.
Figure 16:
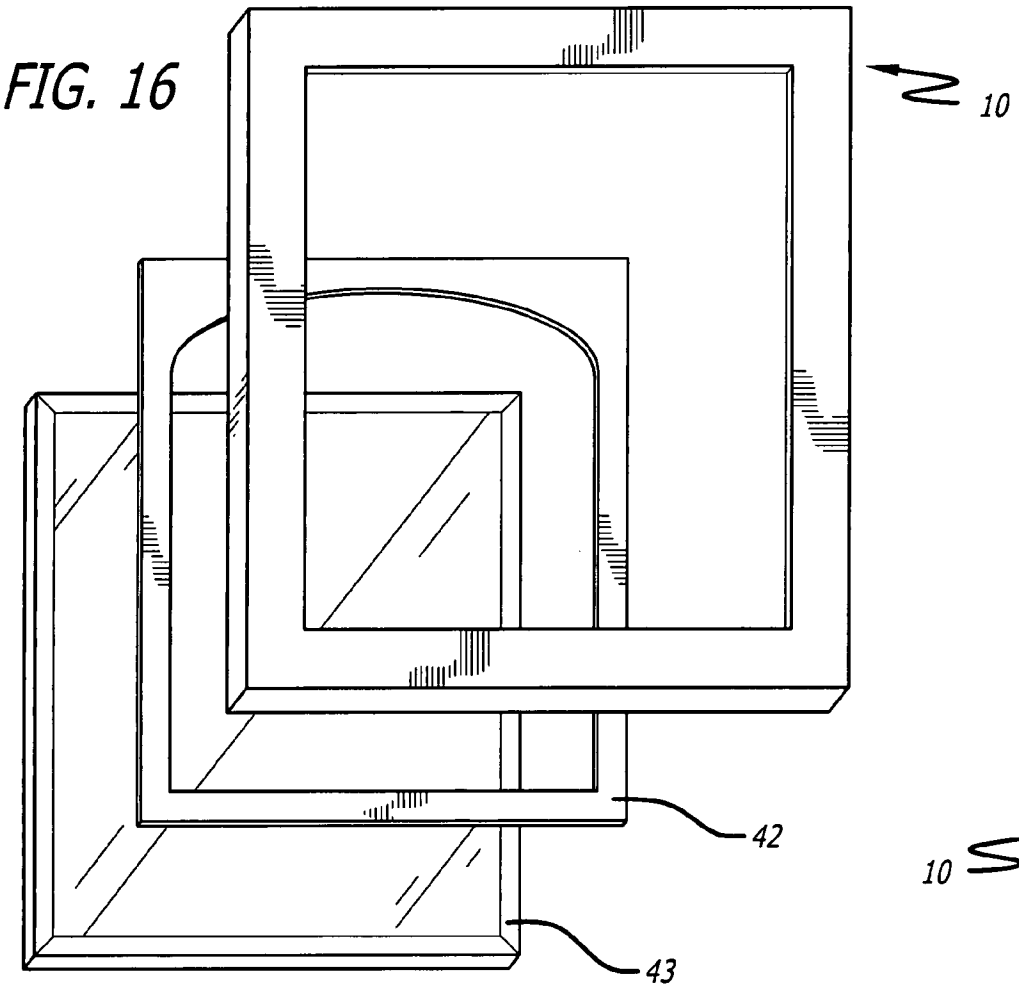
FIG. 16 is an exploded view of a mat and beveled mirror that may be mounted in the frame of FIG. 1.

Although a rectangular framed mirror 33 is shown in FIG. 9, a rectangular mirror, plain or beveled at the corners, may be quickly and easily changed into a uniquely shaped mirror as shown in FIG. 16. Here, frame 10 includes a uniquely configured mat 42 which is placed against ledge 16, then mirror 43 is placed against mat 42 resulting in the final assembly in FIG. 17.

Mats 42 may vary in configuration thus changing the inner configuration presented to view. These mats may be of any suitable materials and colors, such as cardboard, fabric wrapped cardboard, plastic. etc.

It is to be understood that the basic system includes the frame 10, the closure members, such as members 17 to 20, and spacers, such as spacer 34. The system may be shrink-wrapped in a transparent plastic material so that the frame can be viewed by the purchaser. The buyer can thus purchase the framing system, then purchase a mirror, a mat, an oil canvas, etc. The system may include a cardboard backing as backing 28 in FIG. 3.

The distance or width between the back of frame 10 and ledge 16 may be about ⅝" to ¾". Certain artwork, such as mirrors or prints, may be about ¼" thick. The spacers in FIGS. 10 to 15 may thus be about ¼" to ½" to accommodate for the differing thicknesses of the artwork.

Some artwork, such as oil canvases, may be about ¾" thick so no spacers may be needed, a backing, such as backing 28, may or may not be necessary.

Also, if desired, a piece of transparent glass or plastic, such as ultraviolet glass or glare-free or non-reflecting glass, may be placed against ledge 16 particularly if a print or photograph is mounted within the frame 10.

Figure 18:
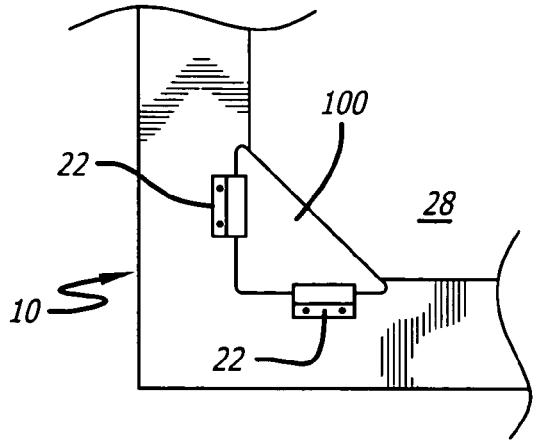
FIGS. 18 to 23 are plan views of a portion of the system of FIG. 1 illustrating various types of closure members that may be used in the system of FIG. 1.
Figure 19:
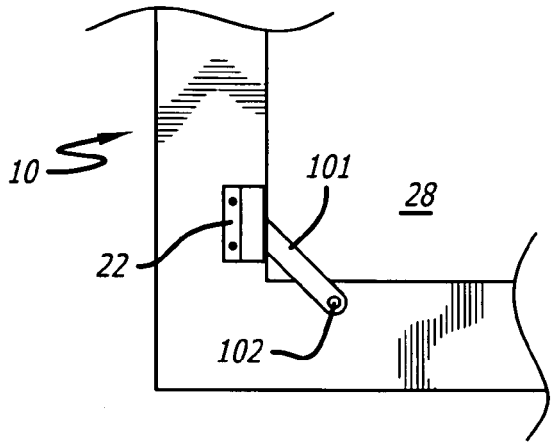
Figure 20:
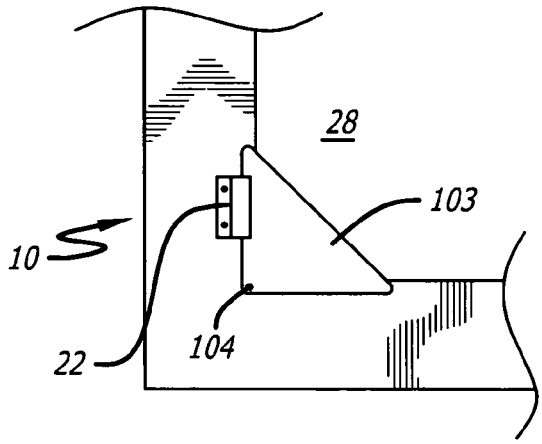

Although a particular type of closure member has been disclosed, variations thereof may occur to an artisan. Thus, as shown in FIG. 18, a pair of clips 22 may be provided at each corner of frame 10 and a triangularly shaped closure member 100 may lock into clips 22 holding, for example, backing 28 in position. In FIG. 19, wherein like numerals refer to like parts of FIG. 18, a bar shaped member 101, swivelly connected to frame 10 at rivet 102, snap fits into clip 22. In FIG. 20, wherein like numerals refer to like parts of FIG. 18, a triangularly shaped member 103 is pivotally connected to frame 10 at rivet 104 and is swiveled into locking engagement with clip 22.

Figure 21:
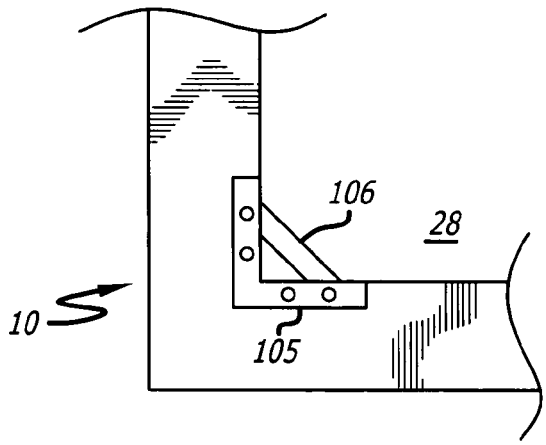

In FIG. 21, wherein like numerals refer to like parts of FIG. 18, the clip 105 here may be similar to clip 22, as previously, discussed, but L-shaped as shown with an elongated bar 106 that snap fits therein.

Figure 22:
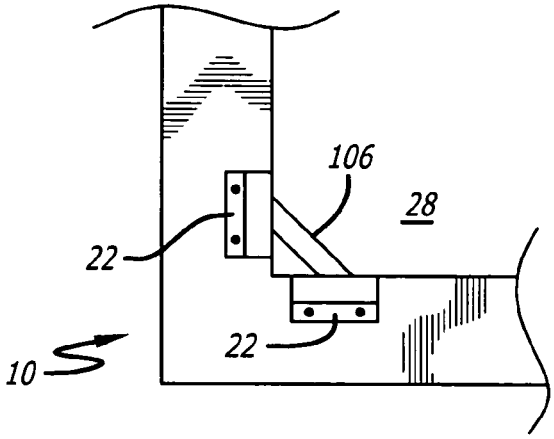

In FIG. 22, wherein like members refer to like parts of FIGS. 18 to 21, bar 106, as in FIG. 21, snap fits into spaced clips 22.

Figure 23:
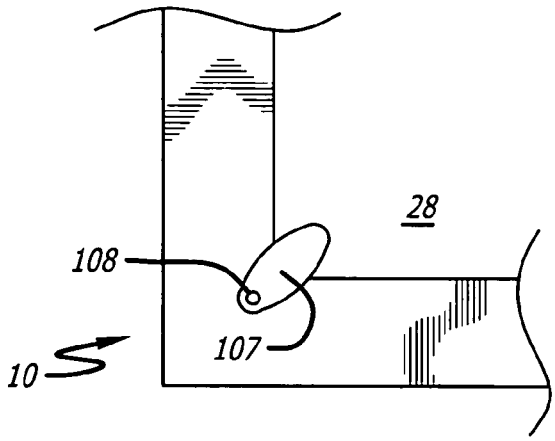

As seen in FIG. 23, wherein like numerals refer to like parts of FIG. 1, a generally oval-shaped closure member 107 is provided rotatably attached to frame 10 at rivet 108. These members 107 may be provided at each corner, along a straight scale, etc.

Figure 24:
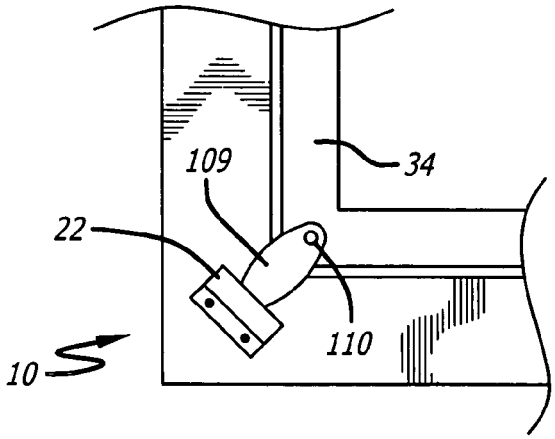
FIG. 24 is a plan view of a portion of the system of FIGS. 1 and 10 illustrating a closure member mounted to one of the spacers of FIGS. 10 to 15.

Finally, as seen in FIG. 24, wherein like numerals refer to like parts of FIGS. 1 and 10, a clip 22 is mounted on frame 10 but the closure member 109, similar to member 107 of FIG. 23, may be pivotally mounted to a spacer frame 34 (FIG. 10) at rivet 110, then swiveled or rotated into locking position as shown.

Such an arrangement may be used with any of the spacers in FIGS. 11 to 15 and may be located in the corners, along the sides, etc.

Although particular embodiments of the invention are disclosed, variations thereof may occur to an artisan and the scope of the invention should only be limited by the scope of the appended claims.

What is claimed is:

1. A framing system comprising:

a) a frame having an outer peripheral configuration surrounding an open area with an inner ledge extending internally of the frame and about the open area of the frame, the frame and the ledge having a front and back, the thickness of the frame between the front and back thereof being greater than the thickness of the ledge between the front and back thereof whereby said ledge provides a support for artwork mounted thereon;

b) a plurality of closure members mounted on said frame at spaced locations about the back of said frame extending about said open area, said closure members being movable from a first position out of said open area to a second position into said open area thus being adapted to abut against any artwork mounted on said ledge;

c) spacer means mountable between said ledge and the back of said frame for compensating in differing thicknesses of artwork adapted to be mounted on said ledge;

d) each of said closure members including a triangularly shaped member having an elongated side edge normally aligned with the edge of said frame on the back thereof adjacent said ledge, each of said closure members being swivelly connected to said frame at one end thereof, and each of said closure members being rotatable to a position overlying said open area;

e) each of said closure members further including a resilient clip fixed to said frame into which said triangularly shaped member is rotatable into fixed engagement therewith; and f) each of said clips including a flat portion fixed to said frame and a resilient split sleeve having an elongated slot configured similarly in thickness to the thickness of said triangularly-shaped member whereby said triangularly-shaped member snap fits into said slot for locking engagement to said clip.

2. The system of claim 1 wherein said spacer means includes a frame spacer having a peripheral frame encircling an open area adapted to abut against said ledge.

3. The system of claim 1 wherein said spacer means includes a flat panel configured similarly to said ledge to abut there against.

4. The system of claim 1 wherein said ledge has a plurality of interconnected sides and said spacer means includes a plurality of strips of a length generally related to the length of one or more sides of said ledge.

5. The system of claim 1 wherein the spacing between the front and back of said ledge is about ⅝" to ¾" and the thickness of said spacer means is between about ¼" to ½".

6. The system of claim 1 wherein said closure members comprise a swivel member swivelly connected to said frame having a length that, when in a first position, extends into said open area of said frame, and, in a second position, extends out of said open area.

* * * * *